United States Patent [19]

Gartner

[11] Patent Number: 4,756,440

[45] Date of Patent: Jul. 12, 1988

[54] ANTI-SPILL LID FOR BEVERAGE CONTAINER

[76] Inventor: William J. Gartner, 10349 N. 79th St., Scottsdale, Ariz. 85258

[21] Appl. No.: 95,662

[22] Filed: Sep. 14, 1987

[51] Int. Cl.[4] ..... A47G 19/22

[52] U.S. Cl. ..... 220/90.4; 220/254

[58] Field of Search ..... 220/90.4, 90.2, 254; 229/7 R

[56] References Cited

U.S. PATENT DOCUMENTS

| | | | |
|---|---|---|---|
| 165,778 | 1/1952 | Olsen | D36/8 |
| 2,534,614 | 12/1950 | Michael | 65/13 |
| 2,623,368 | 12/1952 | Olsen | 65/13 |
| 2,765,639 | 10/1956 | Bryant | 65/13 |
| 3,048,317 | 8/1962 | Cochrane et al. | 229/7 |
| 3,301,459 | 1/1967 | Gardner | 229/7 |
| 3,895,743 | 7/1975 | Christian | 222/143 |
| 3,938,695 | 2/1976 | Ruff | 220/90.4 |
| 4,085,861 | 4/1978 | Ruff | 220/90.4 |
| 4,146,157 | 3/1979 | Dixon, Sr. et al. | 222/424 |
| 4,186,842 | 2/1980 | Albert | 220/206 |
| 4,187,954 | 2/1980 | Striggow | 220/90.4 |
| 4,243,156 | 1/1981 | Lobbestael | 222/541 |
| 4,303,170 | 12/1981 | Panicci | 220/70 |
| 4,350,260 | 9/1982 | Prueher | 220/254 |
| 4,388,996 | 6/1983 | Panicci | 220/70 |
| 4,412,629 | 11/1983 | Dart et al. | 220/90.4 |
| 4,428,498 | 1/1984 | Obey | 220/90.4 |
| 4,589,569 | 5/1986 | Clements | 220/380 |
| 4,600,111 | 7/1986 | Brown | 215/6 |
| 4,619,372 | 10/1986 | McFarland | 220/90.4 |

*Primary Examiner*—George T. Hall

*Attorney, Agent, or Firm*—Cates & Phillips

[57] ABSTRACT

An anti-spill drinking cup lid flexes inwardly, without the use of a vent hole, responsive to drinking suction applied by the cup user. The flexing is by means of a central raised portion of the lid, separated by a flex line from radiating ribs which separate slightly to enlarge the cup lid diameter when liquid is withdrawn through a raised drinking spout provided with apertures sized to prevent passage of liquid. The apertures are located in a valley in the spout end to prevent splash leakage.

10 Claims, 2 Drawing Sheets

ANTI-SPILL LID FOR BEVERAGE CONTAINER

BACKGROUND OF THE INVENTION

The present invention relates generally to a lid or closure for use in combination with a drinking cup, and particularly to such a lid or closure which permits beverage to be drunk with the lid in place, while at the same time being constructed to resist spillage of the beverage when the cup is tipped or jostled.

Beverages such as coffee, tea, soft drinks, and the like are customarily dispensed in styrofoam or paper cups. If the drink is to be carried to another place for consumption, it is usual to supply a lid which can be pressed over the top of the cup and held in place by friction, so that spilling or sloshing of the beverage can be avoided. However, such lids must eventually be removed to permit drinking, and if the container is jostled or tipped over while the lid is off, the contents are spilled.

Numerous attempts have been made to solve the spilling problem by providing lids which remain in place while drinking. Some such lids are provided with a group of small openings through which the liquid may be drunk, the idea being that if the cup is tipped over with such a lid on it, there will be at least a limiting of the amount of liquid spilled. Other lids have been equipped with depressible flaps or tear-out flaps, designed to serve the same purpose. While such lids do provide a certain amount of limitation of the spillage, the presence of holes in the lid nevertheless permits an unacceptable amount of spillage in the event the container should be overturned.

A still further approach to the problem has been to provide the lid with a built-in spout, through which the beverage can be sipped while the lid is still in place. However, in the prior art enbodiments of this approach it has been necessary to furnish the lid with vent holes or slits, to allow air to be taken into the container to compensate for the volume of beverage being withdrawn through the spout. Thus, the vent holes or slits themselves permit spillage of the beverage in the event the cup is tipped or upset.

A further disadvantage of the prior art embodiments has been that many of them are relatively complex in structure, and therefore expensive, and do not lend themselves to mass production methods. Their high cost renders them unsuitable for disposal after a single use.

It is an object of the present invention to provide a beverage cup lid which overcomes the above-mentioned disadvantages of the previously known closures.

It is another object of the invention to provide a cup lid containing a drinking spout formed in said lid but in such conformation as to eliminate the need for vent holes or slits.

It is a further object to produce an economical, disposable lid which can be produced on a mass basis and which permits drinking of the beverage through the lid while eliminating or effectively limiting the amount of spillage in the event the cup is upset.

Other objects and advantages will become apparent as the specification proceeds.

SUMMARY OF THE INVENTION

The present invention relates to an anti-spill lid for use with a beverage container having an open top, said lid comprising a substantially planar cover portion conforming in shape to the open top of the container, peripheral means for sealingly engaging the lip of the container, a raised central portion formed in said cover portion, radially extending reinforcing ribs formed in the cover portion and connecting said central portion through lines of flex, wherein the material is more easily bent, and a drinking spout formed in said cover and extending outwardly therefrom, said spout including in its outer tip a plurality of apertures in communication with the interior of the container. The raised central portion of the anti-spill lid cooperates with the reinforcing ribs, and the flex lines between them, to allow inward flexing of the cover portion to reduce the volume of the container when beverage is withdrawn by mouth vacuum through the spout, and to allow recovery to approximately its original position when suction is released.

In the preferred form of the invention, the outer tip of the spout is recessed inwardly to form a valley, and the apertures are located in the valley in such manner and in such size as to effectively inhibit the outwatd flow of beverage unless negative pressure is exerted.

In the preferred embodiment, the entire lid is of a one piece construction and is preferably inexpensively constructed from vacuum-formed plastic. The design allows typical stacking or nesting of the lids for packaging and dispensing.

BRIEF DESCRIPTION OF THE DRAWINGS

The objects, features and advantages of the invention will be apparent to those skilled in the art from the following detailed description, taken together with the accompanying drawings, in which.

DETAILED DESCRIPTION OF THE INVENTION

Figure 1:
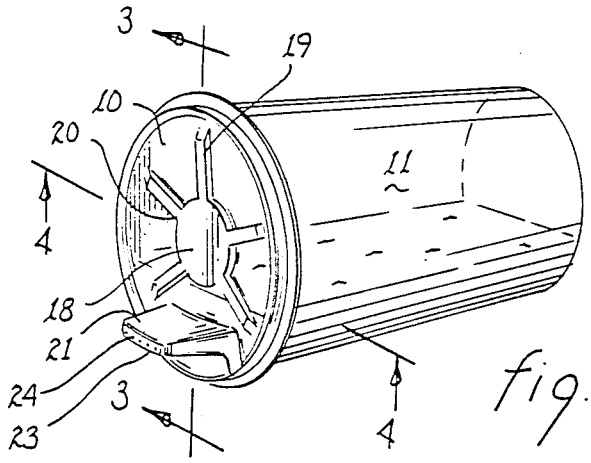
FIG. 1 is a perspective view of the anti-spill lid of the present invention, shown in place on a beverage container.

Referring to the drawings, the improved anti-spill cup closure of the present invention is exemplified by the lid 10 shown in FIG. 1, in place on a drinking cup 11. The cup 11 may be, for example, an expanded styrofoam disposable drinking cup of the sort commonly used to contain beverages for consumption while traveling in an automobile, attending or engaging in sports activities, and the like. The container may be made of any acceptable material, typically foamed plastic, paper, and the like, and is usually thrown away after the beverage has been consumed.

The beverage itself is usually a water based liquid and can be either a hot beverage, such as coffee or tea, or a cold beverage, such as soda pop. The invention is applicable for use with liquids which are higher than plain water in terms of viscosity, surface tension and intramolecular cohesion. Suitable beverages are the aqueous solutions or dispersions of solubilized oils extracted from natural materials. Common examples of such beverages are coffee, tea, colas, and the like.

The lid 10 is preferably of a one piece or integral construction for simplicity and low cost manufacture. It may be made of a stiff, resilient sheet material, for example, a vacuum molded sheet plastic such as commonly used for closures on disposable beverage cups. As shown in FIG. 1 it constitutes a substantially planar cover conforming in shape and size to the open top of the container 11. As illustrated in the drawings, the lid 10 is circular in shape.

Figure 3:
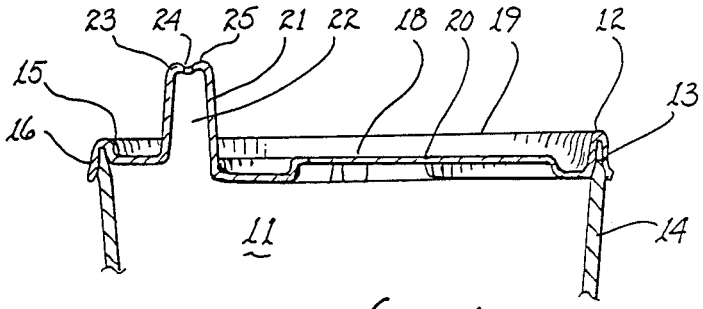
FIG. 3 is a fragmentary sectional view taken substantially along the line 3—3 of FIG. 1.
Figure 2:
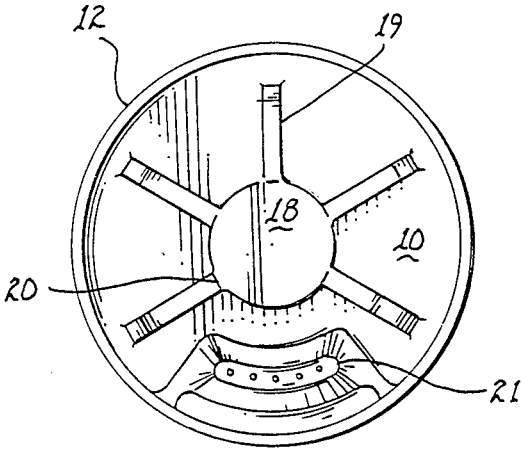
FIG. 2 is a top plan view illustrating the anti-spill lid according to the present invention.
Figure 4:
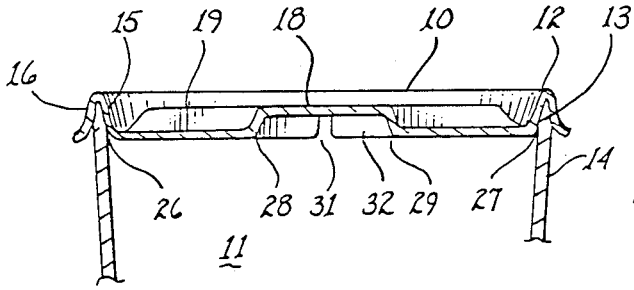
FIG. 4 is a fragmentary sectional view taken substantially along the line 4—4 of FIG. 1.
Figure 4A:
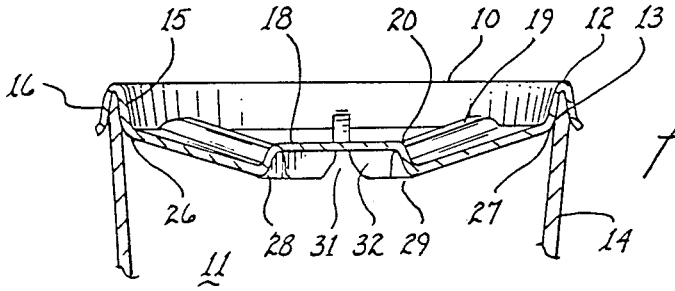
FIG. 4A is a fragmentary sectional view similar to FIG. 4, but showing the central portion of the lid flexed inwardly.

The lid 10 includes a peripheral rim portion 12 which resiliently fits snugly atop the lip 13 of the wall 14 of the beverage container 11, as shown best in FIGS. 3 through 4A. An inner dependent portion 15 and an outer dependent portion 16 are separated radially from each other by a distance small enough to cause the lid 10 to resiliently grip the lip 13 to hold the lid 10 sealingly in place atop the beverage container 11.

A raised central portion 18 is formed as an integral part of the lid 10. The central portion 18 is shown in the drawings as circular in shape and, within certain limits, may occupy an area of varying size, depending upon the size of the beverage container. Generally, the area of central portion 18 should be within the range of about 4% to about 20% of the total area of the lid 10. When the lid 10 and the raised central portion 18 are circular in shape, as shown in the drawings, the diameter of the central portion should be within the range of about 20% to about 40% of the diameter of the lid. In a preferred embodiment, the diameter of the central portion would be approximately 30% of the diameter of the lid itself. The plane of the raised portion 18 is substantially parallel to the plane of the lid 10.

Radially extending raised reinforcing ribs 19 are formed in the lid 10. As shown in the drawings, ribs 19 are connected to, and form extensions of, the central raised portion 18. As shown in FIGS. 3 through 4A, the top surfaces of the ribs 19 are in substantially the same plane as that of raised central portion 18 and are connected to portion 18 by lines of flex 20. The lines of flex may be created during the manufacture of the lid 10 by lessening the thickness of the lid along these lines, or by scoring, or by any other means which will promote bending along these lines when the creation of vacuum inside the container causes atmospheric pressure to flex the central portion inwardly.

Figure 3A:
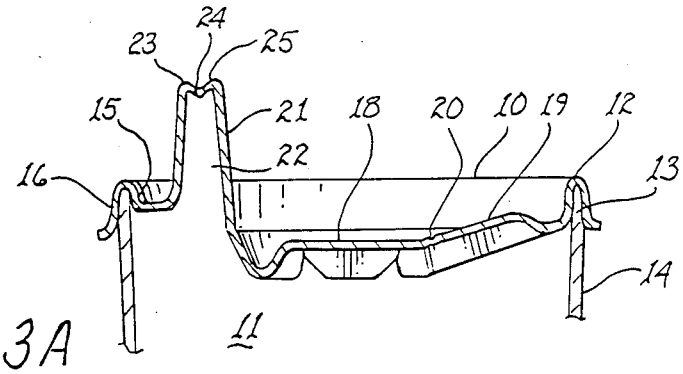
FIG. 3A is a fragmentary sectional view similar to FIG. 3, but showing the central portion of the lid flexed inwardly.

A tubular drinking spout 21 is formed in the lid 10 and extends outwardly from the upper side thereof and near the outer periphery thereof. The spout 21 has a central passageway 22 which is open at its lower end to provide communication with the interior of the cup 11. The outer end 23 of the spout is generally closed but is provided with a series of holes or apertures 24, through which the beverage may be consumed. In the preferred embodiment, and as best shown in FIGS. 3 and 3A, the outer end 23 is provided with a recess or valley 25 in which the holes 24 are located. Recess or dip 25 provides a structure which inhibits loss of beverage by splashing or sloshing and cooperates with other features to create the non-spill feature of the invention.

It is a further feature of the invention that the size of the holes 24 should be controlled within certain limits, also for the purpose of restricting the amount of spillage from the container in the event of upset. Generally, the size of the holes should be within the range of about 0.02 inch to 0.04 inch in diameter. Hole sizes smaller than the above range tend to place an impractical restriction on the ability to drink from the container, while holes larger than the stated range permit increased spillage when the container is turned over. A preferred diameter would be approximately 0.03 inch.

When consumption of the beverage is desired, the user tips the container to the mouth in a natural manner and drinks through the spout 21 by applying a light mouth vacuum to provide the force to start the liquid flowing. As liquid is withdrawn, a negative pressure is created on the interior of the container, and this causes the central portion 18 of the lid 10 to flex inwardly to cause a reduced volume inside the container to compensate for the volume of liquid being withdrawn. After drinking, the user removes his or her lips from the spout 21, thus allowing air to return into the container through the holes 24 in the end of the spout. This eliminates the pressure differential inside the container and causes the lid 10 to return to approximately its normal position, ready for the next drink.

A feature of the present invention is that it eliminates the need for one or more vent holes which would otherwise be required in the lid to permit air to flow in to compensate for the reduced volume of liquid inside the container as the drinking proceeds. The elimination of vent holes or slits eliminates a serious source of spillage which might otherwise occur in the event the container is accidentally upset.

As indicated above, when liquid is removed from the container during the course of drinking through the spout 21, the atmospheric pressure exceeds the pressure on the interior of the container, and this increase in relative atmospheric pressure causes the central portion 18 of the lid 10 to snap inwardly, thus relieving the pressure differential. It is essential to note that this inward flexing would not be obtainable without the structural combination which has been described above in connection with the present invention. In order for the inward flexing to occur, it is necessary (referring to FIGS. 4 and 4A) that the distance between points 26 and 27 in FIG. 4 be allowed to increase to the distance constituting the sum of segments 26 to 28, 28 to 29, and 29 to 27 in FIG. 4A. In the embodiment shown in the drawings, this is accomplished by increasing the length of segment 28 to 29—that is, by increasing the diameter, and thus the circumference, of the circle defining the central portion 18 at the bottom surface of lid 10.

Figure 5:
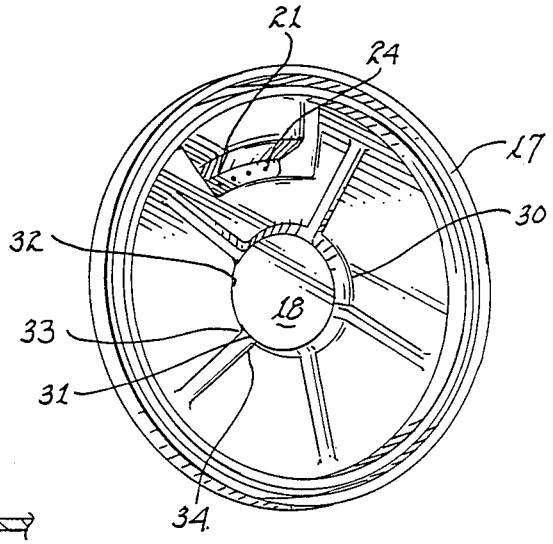
FIG. 5 is a perspective view of the bottom of the anti-spill lid embodying the invention.

Further understanding of this feature will be gained by referring to FIG. 5, which is a perspective view of the underside of the lid 10. In the view provided in FIG. 5, the central portion 18 and the reinforcing ribs 19 appear as recesses in the planar underneath surface of lid 10. In order to permit inward flexing of the central portion 18, it is necessary that the circle 30 defining the circumference of the central portion at the bottom surface of the lid 10 be made larger. The circumference of the ring 30 is interrupted at intervals by gaps 31 located in the sidewall 32 of the central portion 10. These gaps are at the junctions between the central portion 18 and each of the reinforcing ribs 19. When inward pressure is exerted on central portion 18, the structure of the present invention allows the shoulders 33 and 34 to move slightly further apart, thus causing a slight enlargement of each of the gaps 31. Expansion of the gaps 31 provides the needed increase in the circumference of ring 30.

A gap 31 is shown in FIG. 4, in which the lid 10 is in its normal, unflexed state, and also in FIG. 4A, in which the lid 10 is in the flexed state. It will be noted that downward atmospheric pressure on lid 10 has caused gap 31 in FIG. 4 to widen to the extent shown in FIG. 4A. This widening of the gap has resulted in the necessary increase in the diameter of circle 30—i.e., the length of segment 28 to 29.

Figure 6:
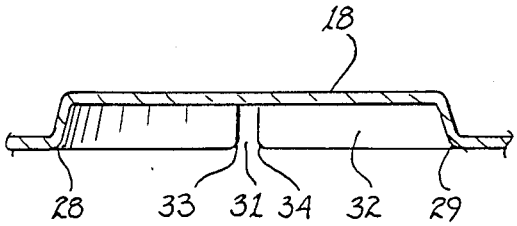
FIG. 6 is a further fragmented view in which the central portion, in the unflexed state, is enlarged and simplified.
Figure 6A:
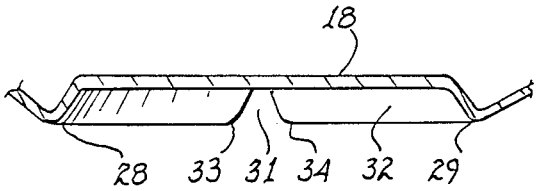
FIG. 6A is a further fragmented view in which the central portion, in the flexed position, is enlarged and simplified.

This feature is further illustrated in FIGS. 6 and 6A, in which the cross-sectional view of the central portion 18 is enlarged and simplified, and the increase in size of the gap 31 is slightly exaggerated. FIG. 6 shows the unflexed state, and FIG. 6A shows the flexed position. It will be noted that the increase in the size of the gap 31 in FIG. 6A has caused an increase in the distance between points 28 and 29. As shown in FIGS. 4 and 4A, this increase in distance is necessary to permit the central portion 18 to flex inwardly.

As previously mentioned, the ability of the lid 10 to flex inwardly permits a structure in which there are no vent holes in the lid. The only holes provided are those located at the top of spout 21, and such holes do not act as vent holes, since they are covered by the consumers lips during drinking.

The container lid of the present invention provides the following features which are significantly advantageous in terms of usefulness and economics:

1. A container equipped with the lid of the present invention is virtually leak-proof, even though jostled or tipped. Yet it is possible to drink beverage from the cup in a normal fashion without removing the lid and without the added expense of straws. The special structure enabling inward flexing of the lid during drinking permits elimination of the usual vent holes, and this feature, enhanced by the use of a recessed spout tip to protect the drinking holes, provides effective non-spill operation.

2. The lid has a simple, uncomplicated structure which can be mass-produced on conventional plastic forming machinery, and thus it is an inexpensive item, fitting in well with the need for disposability.

3. The structure of the lid allows for stacking or nesting for purposes of packaging and dispensing.

4. The design provides for dissipation of heat of the liquid just prior to contact with the lips and thus avoids burning.

Although preferred embodiments of the invention have been described herein in detail, it will be understood by those skilled in the art that variations may be made thereto without departing from the spirit of the invention.

What is claimed is:

1. An anti-spill lid for use with a beverage container having an open top, said lid comprising:

(a) a substantially planar cover portion conforming in shape to the open top of the container;

(b) peripheral means for sealingly engaging the lip of said container;

(c) a raised central portion formed in said cover portion;

(d) radially extending reinforcing ribs formed in said cover portion and connecting with said central portion through lines of flex; and (e) a drinking spout formed in said cover and extending outwardly therefrom, said spout including in its outer tip a plurality of apertures in communication with the interior of said container said raised central portion cooperating with said reinforcing ribs and the lines of flex therebetween to allow inward flexing of the cover portion to reduce the volume of said container when beverage is withdrawn through said spout.

2. The anti-spill lid of claim 1 wherein the outer tip of said spout is depressed inwardly to form a valley, and the said apertures are located in said valley.

3. The anti-spill lid of claim 1 wherein the size of said apertures is within the range of about 0.02 to 0.04 inch in diameter.

4. The anti-spill lid of claim 1 wherein the apertures in the tip of said spout are the only apertures in said lid.

5. The anti-spill lid of claim 1 wherein the raised central portion is circular in shape and has a diameter in the range of about 20 to 45% of the diameter of the lid.

6. The anti-spill lid of claim 1 wherein the raised central portion is in substantially the same plane as the surface of said reinforcing ribs.

7. The anti-spill lid of claim 1 wherein the drinking spout is substantially perpendicular to the said cover portion.

8. The anti-spill lid of claim 1 wherein the drinking spout is located adjacent the outer periphery of said cover portion and angles outwardly toward said periphery.

9. An anti-spill non-vented lid for use with a beverage container having an open top, said lid comprising:

(a) a flexible planar cover portion conforming in shape to the open top of the container;

(b) friction means for sealingly engaging the lip of said container;

(c) a raised circular element formed in the center of said cover portion and occupying approximately 4 to 20% of the area of said cover portion;

(d) radially extending reinforcing ribs formed in said cover portion and connecting with said circular element through lines of flex;

(e) a drinking spout formed in said cover portion, adjacent the periphery thereof and extending outwardly therefrom, said spout including in a valley formed in its outer tip a plurality of circular apertures sized within the range of about 0.02 to 0.04 inch in diameter, said raised element cooperating with said reinforcing ribs and the lines of weakness therebetween to allow inward flexing of the cover portion when drinking suction is applied through said spout and to allow recovery to its original position when suction is released.

10. An anti-spill lid for use with a beverage container having an open top, said lid comprising:

(a) a substantially planar cover portion conforming in shape to the open top of the container;

(b) peripheral means for sealingly engaging the lip of said container;

(c) a drinking spout formed in said cover and extending outwardly therefrom, said spout including in its outer tip a plurality of apertures in communication with the interior of said container;

(d) a raised central portion formed in said cover portion, said central portion having a side wall defining the periphery thereof; and (e) a plurality of gaps in said side wall, capable of widening under pressure, to increase the peripheral dimension of said raised central portion and permit inward flexing of said cover portion when beverage is withdrawn through said spout.

* * * * *